US005412212A

United States Patent [19]

Rushing

[11] Patent Number: 5,412,212

[45] Date of Patent: May 2, 1995

[54] CORONA-CHARGING APPARATUS AND METHOD

[75] Inventor: Allen J. Rushing, Rochester, N.Y.

[73] Assignee: Eastman Kodak Company, Rochester, N.Y.

[21] Appl. No.: 162,545

[22] Filed: Dec. 6, 1993

[51] Int. Cl.[6] ..... G03G 15/02

[52] U.S. Cl. ..... 250/325; 355/221; 355/225; 361/229

[58] Field of Search ..... 250/325; 355/225, 221; 361/229

[56] References Cited

U.S. PATENT DOCUMENTS

| | | | |
|---|---|---|---|
| 2,890,343 | 12/1957 | Bolton | 250/49.5 |
| 3,527,941 | 7/1968 | Culhane et al. | 250/49.5 |
| 3,678,350 | 7/1972 | Matsumoto et al. | 250/325 |
| 3,688,107 | 8/1972 | Schneider et al. | 250/49.5 ZC |
| 4,245,272 | 1/1981 | Rushing et al. | 361/229 |
| 4,248,519 | 2/1981 | Urso | 355/221 |
| 4,695,723 | 9/1987 | Minor | 250/325 |
| 5,060,017 | 10/1991 | Ueda | 355/221 |

*Primary Examiner*—Jack I. Berman
*Attorney, Agent, or Firm*—Norman Rushefsky

[57] ABSTRACT

A method and apparatus for corona-charging a charge-receiving member having image frames used in recording, such as in electrostatographic recording. In the method and apparatus there is synchronizing movement of the charge-receiving member with the application of different voltages to the corona-charging apparatus. Thus, during a transition period when a region of the charge-receiving member that is adjacent a leading edge of an image frame is aligned with the charging apparatus, an element of the charging apparatus is provided with an overcharge voltage level substantially higher than a voltage level suitable for achieving on the image frame an aim point voltage level to which the image frame is to be charged to provide a relatively rapid rate of charge deposition on the charge-receiving member. The voltage on the element is thereafter adjusted to a lower voltage level suitable for achieving an aim point voltage level on the image frame. The element is preferably a grid but may be a corona-charging wire.

16 Claims, 3 Drawing Sheets

CORONA-CHARGING APPARATUS AND METHOD

BACKGROUND OF THE INVENTION

1. Field of the Invention

This invention relates to apparatus for establishing a uniform, predetermined charge on successive image frames of a charge-receiving element.

2. Description of the Prior Art

Although the corona-charging apparatus of the present invention has general applications, one preferred application is in the field of electrostatographic recording such as with electrophotographic apparatus (such as copiers or printers). In copier corona-charging apparatus, current from a corona-emitting electrode establishes a generally uniform electrostatic charge on an image segment of a charge-receiving element having a photoconductive insulating layer. The charged segment is then advanced to an exposure station where it is exposed to image-forming radiation to form a latent electrostatic image of a document to be copied. The latent image is thereafter developed and substantially transferred to paper upon which the copied image is to appear.

Various methods are known for adjusting the charge on a charge-receiving element by the corona-charging apparatus. For example, the speed of the charge-receiving element past the corona-emitting electrode can be varied to adjust its time of exposure to corona current. Another method for adjusting the charge is to vary the charging rate. Control electrodes such as grids, to which has been applied a potential approximately equal to that to which the charge-receiving element is to be charged are located between the corona-emitting electrode and the element. Current flow from the electrode to the element can be adjusted by varying the voltage of the grid.

Typically, the optimum grid voltage changes when reproducing successive original documents, to compensate for variances in background density of the original documents. Another application involves development of different image frames with different colored toners to be transferred to the same receiver sheet or to a different receiver sheet. Because of the difference in materials in the toners, they typically require different charging levels. Thus, adjustment of the charging rate between image segments is not new, and has been effected by changing the grid voltage after the trailing edge of one image segment has cleared the corona-charging apparatus and before the leading edge of the next image segment reaches the apparatus. However, this process undesirably requires the charge-receiving element to contain a physical transition region between the trailing edge of one image area segment and the leading edge of the next image area segment so that no portion of either image area segment is below the corona-charging apparatus during the period of grid voltage change. Thus, the image area segments on the charge-receiving element must be spaced apart by a distance equal to at least the width of the corona charging zone (i.e., the dimension of the charge-receiving apparatus in the direction of movement of the charge-receiving element).

The need for providing such spaces between the successive image area segments reduces the number of image area segments which can be located within a predetermined length of charge-receiving element. This in turn necessitates driving the charge-receiving element at a faster linear speed to make a predetermined number of copies per unit time than would be necessary if the image area segments were closer together in order to produce the same number of copies per unit time.

In order to overcome this problem, the prior art as exemplified by U.S. Pat. No. 4,695,723 suggests that a charging apparatus include electrodes for creating a corona discharge and a composite grid between the electrodes and a moving charge-receiving element. The composite grid includes a plurality of conductive controlled grid sets with at least one grid wire per set. The grid wires extend in a direction transverse to the charge-receiving element, and the voltage on the wires of each grid set is adjustable independently of the voltages on the wires of the other grid sets. Regulator means are provided for synchronizing the voltage of the wires of each grid set with the movement of the charge-receiving element. Thus, voltage on a grid set can be changed when that grid set is over the transition region between the trailing edge of one image area segment to the leading edge of the successive image area segment, and the transition region need only be as wide as the width of one grid wire set. While this greatly reduces the length of the transition region and increases the number of image area segments which can be located on a predetermined length of charge-receiving element, it does so at the cost of plural power supplies.

In U.S. Pat. No. 3,527,941, there is disclosed an electrostatic charging device which requires only one charging station but which applies a uniform charge at a relatively high rate of speed. The device comprises a corona discharger which is separated from a photoconductor by a grid. The grid produces a nonuniform field so that as the photoconductor is moved past the charging station it is subjected to a progressively lower potential which finally becomes the potential to which the photoconductor is to be charged. In specific embodiments disclosed in this patent, the electrostatic field produced by the grid is made nonuniform by (1) applying graduated voltages to the individual elements of the grid, (2) or by graduating the spacing between the grid elements themselves, or (3) by a combination of the above two methods. A problem with this device is that means must be provided for simultaneously applying different grid voltages to different grid elements and the assembly is required to be relatively large.

In U.S. Pat. No. 4,245,272, primary charging of a moving electrographic photoconductor to a nominal potential level is achieved with low sensitivity to variation in system parameters such as photoconductor capacitance, photoconductor velocity and/or charger efficiency. Separately addressed, AC corona discharge units are arranged and predeterminedly biased to first substantially overcharge the photoconductor relative to the nominal potential and then discharge the photoconductor to exit at the nominal potential level. As noted in this patent, at least two corona wires are required for first predeterminedly overcharging above the nominal voltage and second predeterminely discharging so that the photoconductor exits the charging station at the nominal level. Thus, this charging device of the prior art also requires separate power supplies.

In U.S. Pat. No. 2,890,343, an area charging device is disclosed for charging a xerographic drum wherein a charging unit is selectively turned on and off to provide a sensitized area with sharp leading and trailing edges of the voltage profile of the area. As disclosed in this patent, grid wires are electrically isolated from each other so that they can be subject to different bias potentials. A commutator is provided and synchronized with movement of the drum to sequentially change the potential on each grid during the commencement of charging of an area. Initially, all grid wires are at one potential (−800 volts) to block flow of charge to the drum. Thereafter, the potential is changed to +800) volts and that portion of the drum then passing beneath the grid wire is exposed to the corona discharge. Each grid wire is energized successively while the grid wires ahead of the energized grid wires are maintained at −800 volts, until the entire charging unit is turned on. At the trailing edge, the image frame process is worked in reverse. A problem with this apparatus is the requirement to separately electrically isolate each grid wire and the apparatus suggests a relatively large size charging unit in the direction of movement of the area being charged.

In U.S. Pat. No. 3,688,107 there is disclosed two embodiments of charging apparatus for rapidly and uniformly applying electrostatic charge onto an electrostatographic plate. In one embodiment, a stationary plate is located beneath a relatively large area charging scorotron. A screen wire grid is firstly biased to a very high voltage for a transient period defined by an RC time constant and thereafter the screen returns to its conventional bias level to bias the plate to that latter bias level. A problem with this apparatus is that it requires a very large charging device to charge an entire image frame area and it is inherently slow in terms of productivity because the plate is stationary during charging. In a second embodiment described in U.S. Pat. No. 3,688,107, a charging apparatus for charging a moving electrostatographic plate is described. In this second embodiment, a multiplicity of voltages is impressed upon the screen wires with the first wire having a large initial potential and other wires downstream having progressively lower potentials. It is thus apparent that this solution, too, requires separate electrical isolation of the grid sets.

In still another known approach a relatively high level of charge is provided by a corona charger and an auxiliary electroluminescent light panel is used to knock down the voltage to the desired $V_o$.

SUMMARY OF THE INVENTION

It is therefore an object of the invention to provide an inexpensive charging apparatus and method for uniformly charging a moving electrostatographic recording surface that minimizes the transition region between successive image area segments.

The foregoing, as well as other objects and advantages, are accomplished by providing, in accordance with one aspect of the invention, a novel corona-charging apparatus comprising: charging means for charging successive image frames of a moving charge-receiving member to different aim point voltage levels, said charging means including a grid set; control means for adjusting the voltage of said grid set to regulate the rate of charge level produced on a portion of the charge-receiving member aligned with the charging means; and regulator means, cooperating with said control means, and synchronized with the movement of the charge-receiving member such that the voltage of said grid set is adjusted, during a transition period wherein a region of said charge-receiving member that is adjacent a leading edge of an image frame is aligned with the charging means, to an overcharge voltage level substantially higher than a voltage level suitable for achieving on the image frame an aim point voltage level to which the image frame is to be charged to provide a relatively rapid rate of charge deposition on the charge-receiving member and tile voltage on the grid set is thereafter adjusted to a lower voltage level suitable for achieving an aim point voltage level on the image frame.

In accordance with another aspect of the invention, there is provided a method for corona-charging a charge-receiving member, said method comprising the steps of: synchronizing movement of the charge-receiving member with the application of voltage to a corona-charging apparatus so that, during a transition period, an element of the charging apparatus is provided with an overcharge voltage level substantially higher than a voltage level suitable for achieving an aim point voltage level to which an image frame on the charge-receiving member is to be charged to provide a relatively rapid rate of charge deposition on the charge-receiving member and the voltage on tile element is thereafter adjusted to a lower voltage level suitable for achieving tile aim point voltage level on the image frame.

In accordance with another aspect of the invention, there is provided a method for corona-charging a charge-receiving member, said method comprising the steps of synchronizing movement of the charge-receiving member with tile application of voltage to a corona-charging apparatus so that, during a transition period wherein a region on said charge-receiving member that is adjacent a leading edge of an image frame is aligned with the charging apparatus, an element of the charging apparatus is provided with an undercharge voltage level substantially lower than a voltage level suitable for achieving an aim point voltage level to which an image frame on the charge-receiving member is to be charged to provide a relatively low rate of charge deposition on the charge-receiving member and the voltage on the element is thereafter adjusted to a higher level suitable for achieving the aim point voltage level on the image frame.

BRIEF DESCRIPTION OF THE DRAWINGS

In the detailed description of the preferred embodiments of the invention presented below, reference is made to the accompanying drawings in which.

FIG. I is a side elevational view in schematic form of a portion of electrophotographic apparatus including corona-charging apparatus made in accordance with the invention.

DESCRIPTION OF THE PREFERRED EMBODIMENT

The corona-charging apparatus of the present invention has general applications but will be described herein in a form particularly useful in electrophotographic apparatus (i.e., copiers or printers). Because such apparatus is well known, the present description will be directed in particular to elements forming part of or cooperating more directly with the present invention.

Figure 1:
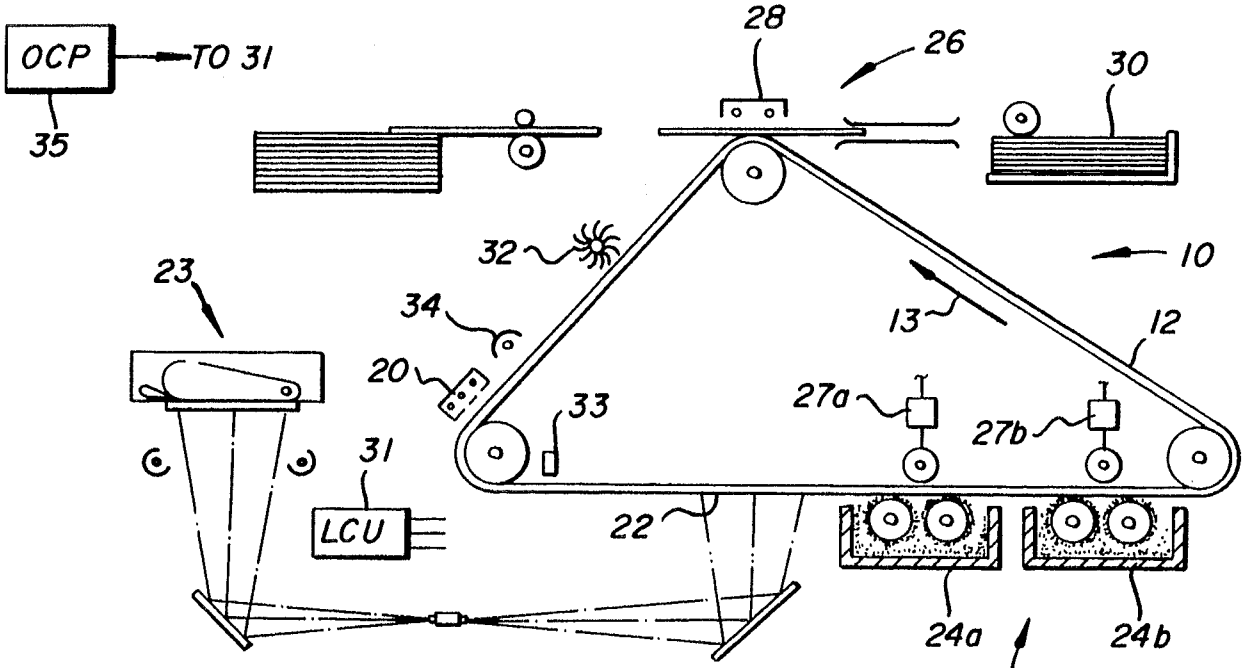

With reference to FIG. 1, a web type copier 10 includes a charge-receiving element 12 mounted for movement in the direction of arrow 13 about an endless path, past various operative stations. A charge-receiving element 12 includes a photoconductive insulating layer overlying a thin, electrically conductive layer, both supported on a film. The conductive layer is electrically connected to ground or other reference potential source by edge contact with rollers of the apparatus or by other techniques known in the art.

Operative stations of copier 10 include a charging station at which corona-charging apparatus 20 applies an overall primary charge to the external surface of photoconductive insulating layer 14. After receiving the primary charge, an image area segment of charge-receiving element 12 advances past an exposure station 22 where the segment is imagewise exposed to image forming radiation from a document located on the platen of a recirculating feeder 23. Alternatively, the exposure may be provided in an electronic imaging source such as an LED (light-emitting diode) or laser printing device or other suitable means for image-wise modulating the uniform charge. The resultant latent electrostatic image then residing on the segment is next advanced over a magnetic brush development station 24 where toner is attracted to the charge pattern corresponding to dark image areas of the document. The developed image is then advanced to a transfer station 26 where the toner image is transferred by corona discharge device 28 to paper, fed from supply 30. In a web-type of copying apparatus, successive image frames are spatially separated on the charge-receiving element or electrophotoconductive web. The invention is also applicable to drum-type, charge-receiving elements and with such element the successive image segments may be temporally spaced, i.e., spaced in time as is well known.

The image segment from which the toner is transferred advances past a cleaning station 32 in preparation for another copy cycle. Erase illumination source 34 can be located after the cleaning station to dissipate residual charge prior to initiating another copy-making sequence of the image segment.

The development station 24 may be comprised of two toner stations for development of images with different colors. Thus, toner station **24*a* may have black toner and toner station 24*b* may have red or some other color. Actuators 27*a*, 27*b* are provided on opposite sides of the web to bring the web into contact with the appropriate toner station development materials. These actuators are responsive to signals from a logic and control unit (LCU) 31 that includes one or more microcomputers that are programmed to operate in accordance with well known techniques for synchronizing operation of the various components or stations of the apparatus. Clock pulses from one or more encoders 33 are sent to the LCU to time control of the various operations. As is well known, these encoders sense perforation or other indicia on the web and their signals may be counted or otherwise used to enable the LCU to control signals to the various components. Also associated with the apparatus is an operator control panel 35** including buttons and/or a keyboard and displays for allowing an operator to input a request for a copying operation such as number of copies, color, etc. Where duplex or the transfer of two-color images to one side of a sheet is desired, a turn around roller or duplex tray may be provided as is well known in the art. Where operation is only in one color, the second color station may be omitted. However, as noted above, even with one-color operation different originals may require different levels of charging potential, $V_o$, on the web or drum before imagewise exposure of the image frame upon which the image of each original is to be developed.

Figure 2:
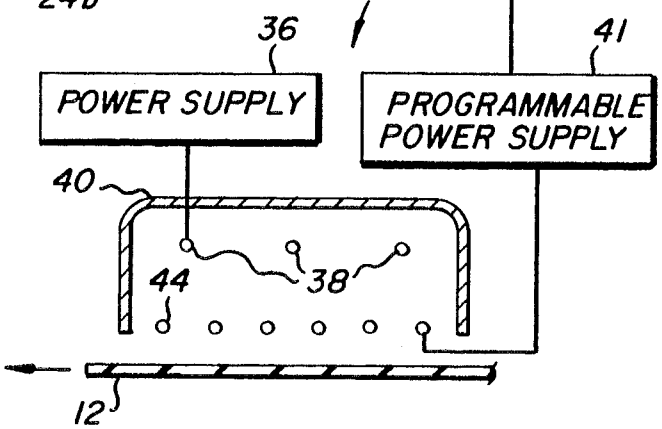
FIG. 2 is a schematic cross-sectional view of corona-charging apparatus in accordance with the present invention.

FIG. 2 illustrates details of a preferred embodiment of corona-charging apparatus 20 of FIG. 1. A high voltage AC power supply 36 is connected to one or more corona-emitting electrode wires 38. Electrode wires 38 are enclosed in a grounded shield 40. A portion of a charge-receiving element 12, such as illustrated in FIG. 1, is shown moving below shield 40.

A conductive control grid 44 is positioned between corona-emitting electrodes 38 and charge-receiving element 12. The grid wires are uniformly spaced from and extend in a direction traverse to the direction of movement of the charge-receiving element. All the grid wires are electrically connected together at the same voltage potential.

The control grid has associated therewith programmable voltage controller or power supply 41 for regulating the charge on the grid wires which make up the control grid. The voltage controller may have a programmable active DC voltage source, as is well known in the art. The voltage controller is adjusted by a programmable regulator which is in turn responsive to the LCU 31. The LCU 31 detects the spatial relationship of the successive image area segments to the charge-receiving element at corona-charging apparatus 20, whereupon voltage controller sequentially adjusts the voltage of the grid wires of the control grid 44 in accordance with the characteristics of the document original and/or color toner corresponding to that image area segment and in timed relation with the movement of the charge-receiving element.

An example of instances wherein copier production parameters are advantageously changed in accordance with the characteristics of the document original is described in U.S. Pat. No. 4,451,137, issued May 29, 1984 to R. W. Farley. Briefly, that patent discloses that during a production run of copying a multi-sheet document original using a recirculating feeder, predetermined adjustments of the production parameters for individual sheets of the document original may be stored in the copier's memory for later use.

Thus, the parameters for copying successive sheets of a document original may be inputted at a central processor CP and stored in the memory of a logic and control unit 31. As the image area segment for one sheet of the document original advances under the corona-charging apparatus in accordance with the present invention, the control grid is adjusted in accordance with the teaching set forth below.

Figure 3:
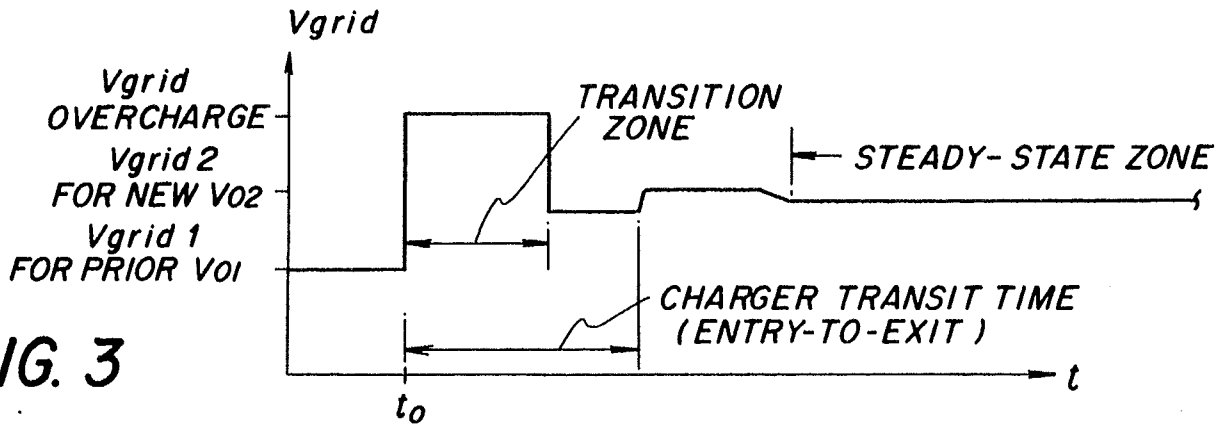
FIG. 3 is a graph illustrating grid voltage as a function of time for the corona-charging apparatus of FIG. 1.

In accordance with the present invention a single Vgrid power supply is driven through a specific voltage versus time profile (Vgrid versus time), depending on the film velocity, charger width, charging time constant, and desired width of the transition zone, as well as the specific before and after $V_o$ levels. With reference to FIG. 3, the general shape of these profiles is to switch first for a time equal to the desired transition time to an extreme value beyond the final steady state Vgrid, then to a level between the initial and final steady-state values, and finally converge toward the final steady-state value.

For a given configuration, a V grid profile is determined empirically to switch between any two $V_o$ levels in the required short transition zone. This profile is then scaled and/or offset to switch, upward or downward, between other $V_o$ levels with no degradation of $V_o$ transition time or flatness.

These Vgrid profiles are then applied whenever $V_o$ adjustments are required, e.g. for process control purposes or to accommodate the different $V_o$ requirements of different color toners in successive frames. The $V_o$ transitions can be accomplished within a short interframe, and without the expense of multiple power supplies or $V_o$ knockdown devices of the prior art.

Figure 5:
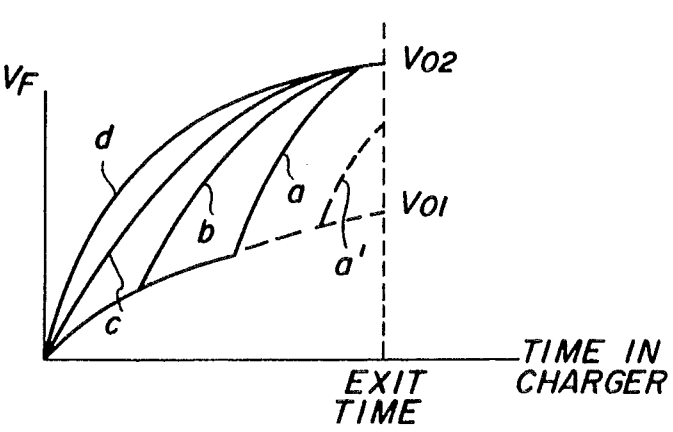
FIG. 5 is a graph indicating the time change in voltage levels on the charge-receiving element at the various reference points.
Figure 4:
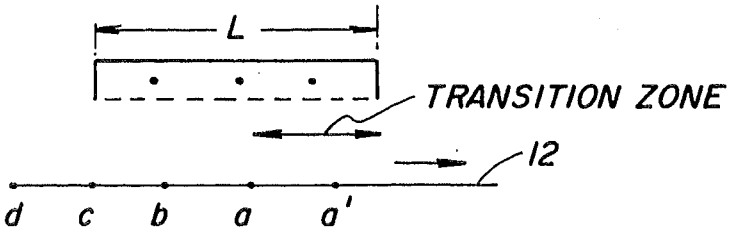
FIG. 4 is a sketch of the charger of the invention in conjunction with reference points on the charge-receiving elements.

At time $t_o$ (see also FIG. 3), points a, b and c on the film 12 are as shown in FIG. 4. The potential of these points as they advance through the charger is as shown in FIG. 5. Note that spots a, b, c, d and all the subsequent spots exit at same new high $V_{02}$. $V_{grid}(t)$ is shaped to make this happen.

Figure 6:
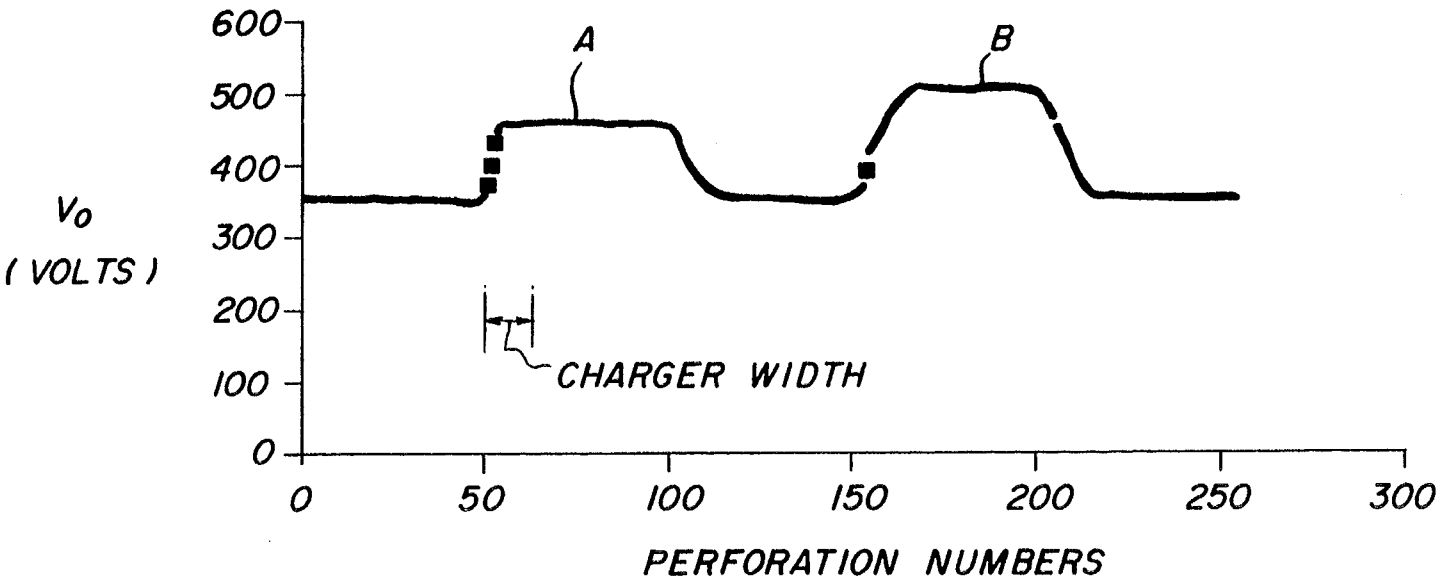
FIG. 6 is a graph illustrating operation of the corona-charging apparatus of the invention as programmed in accordance with the invention versus a conventional programming operation.

With reference now to FIG. 6, a test was run using the charger of the invention and comparing same to charging in a conventional manner wherein the grid wires were set to the new aim point for $V_o$. In this example, the controls to the charger are programmed so that the charger operates in accordance with the invention to provide an initial fast rise time in charging rate and then stepped down to the $V_o$ aim point. Specifically, the voltage on the grid is raised from 300 volts initially to 600 volts for a short duration represented by 4 clock perforations (1.9 cm web length at 0.49 m/sec web speed), then $V_{grid}$ is dropped to 410 volts for 8 clock perforations and then increased to 445 volts for 6 clock perforations and then remains at 440 volts at least for the duration for charging the image frame A. Compare this with the following image frame B wherein the charger grid is merely raised from 300 to 500 volts to eventually obtain a film $V_o$ of about 500 volts. As can be seen, the rise time is significantly longer and therefore requires a larger interframe distance to ensure charge uniformity over the entire image frame.

As can be seen from tile preferred embodiment, the voltage profile on the grid begins with an extreme step for a time corresponding to the required transition zone, followed by a few slightly oscillating steps converging toward the final, steady-state value. In the example described above, a standard negative charging grid-controlled AC charger was used with a Vgrid power supply from Trek Cor-a-trol model 610C that features a very good step response capability. With a primary charged grid width of 2.5 inches (6.35 cm) the normal Vo transition zone was about 14 clock perforations, corresponding approximately to the width of the charger. For frame A, the grid overshoot in this example is 114% of the increase between the two steady-state values. That is, the overshoot grid voltage minus the final grid voltage at steady-state divided by the difference between the new and prior steady-state values is 114% in this example.

The invention is also applicable to changing Vo downwardly with a short transition region. For example, the $V_{grid}$ voltage profile for a decrease from 440 volts steady-state to 300 volts steady-state may be provided by essentially inverting the profile discussed for the example of FIG. 6. Thus, an initial 300 volts step downward from 440 volts lasting 4 clock perforations then a 190 volt step upward lasting 8 clock perforations, then a 35 volts step downward lasting 6 perforations and then a 5 volts step upward to the new steady-state value of 300 volts.

While the invention has been described with reference to grid-controlled AC chargers, it is also applicable to gridless biased AC chargers and grid-controlled DC chargers. The $V_{grid}$ profiles described herein are determined empirically for specific configurations according to charger width, film velocity, charging time constant, and the required transition zone width. Fast $V_o$ transition and good $V_o$ uniformity are obtained with easily implemented piece-wise constant $V_{grid}$ profiles consisting of only a few accurately-timed steps.

There has thus been provided an improved corona-charging device that provides for shortened transition zones and wherein these zones can be made smaller than the charger width in the direction of web or drum travel. No "knockdown" exposure device is required, and the film is not overcharged to a voltage higher than what is finally needed.

The invention has been described in detail with particular reference to preferred embodiments thereof and illustrative examples, but it will be understood that variations and modifications can be effected within the spirit and scope of the invention.

I claim:

1. Corona-charging apparatus comprising:

charging means for charging successive image frames of a moving charge-receiving member to different aim point voltage levels, said charging means including a grid set;

control means for adjusting the voltage of said grid set to regulate the rate of charge level produced on a portion of the charge-receiving member aligned with the charging means; and regulator means, cooperating with said control means, and synchronized with the movement of the charge-receiving member such that the voltage of said grid set is adjusted, during a transition period wherein a region of said charge-receiving member that is adjacent a leading edge of an image frame is aligned with the charging means, to an overcharge voltage level substantially higher than a voltage level suitable for achieving on the image frame an aim point voltage level to which the image frame is to be charged to provide a relatively rapid rate of charge deposition on the charge-receiving member and the voltage on the grid set is thereafter adjusted to a lower voltage level suitable for achieving the aim point voltage level on the image frame.

2. The apparatus of claim 1 in combination with an electrostatographic recording means for imagewise modulating the charge on said image frame, developing an image and transferring the developed image to a receiver sheet.

3. A method for corona-charging a charge-receiving member having image frames used in recording, said method comprising the steps of:

synchronizing movement of the charge-receiving member with the application or voltage to a corona-charging apparatus so that, during a transition period wherein a region of said charge-receiving member that is adjacent a leading edge of an image frame is aligned with the charging apparatus, an element of the charging apparatus is provided with an overcharge voltage level substantially higher than a voltage level suitable for achieving on the image frame an aim point voltage level to which the image frame is to be charged to provide a relatively rapid rate of charge deposition on the charge-receiving member and the voltage on the element is thereafter adjusted to a lower voltage level suitable for achieving the aim point voltage level on the image frame.

4. The method of claim 3 and wherein the element is a grid.

5. The method of claim 4 including the steps of electrostatographically recording an image on said image frame, developing the image and transferring the image to a receiver sheet.

6. The method of claim 3 and wherein the voltage level on the element varies after the overcharge voltage level and before reaching a steady-state voltage level suitable for achieving the aim point voltage level.

7. The method of claim 6 and wherein the element is a grid.

8. The method of claim 7 including the steps of electrostatographically recording an image on said image frame, developing the image and transferring the image to a receiver sheet.

9. A method for corona-charging a charge-receiving member having image frames used in recording, said method comprising the steps of:

synchronizing movement of the charge-receiving member with the application of voltage to a corona-charging apparatus so that, during a transition period wherein a region of said charge-receiving member that is adjacent a leading edge of an image frame is aligned with the charging apparatus, an element of the charging apparatus is provided with an undercharge voltage level substantially lower than a voltage level suitable for achieving on the image frame an aim point voltage level to which the image frame is to be charged to provide a relatively low rate of charge deposition on the charge-receiving member and the voltage on the element is thereafter adjusted to a higher voltage level suitable for achieving the aim point voltage level on the image frame.

10. The method of claim 9 including the steps of electrostatographically recording an image on said image frame, developing the image and transferring the image to a receiver sheet.

11. The method of claim 10 and wherein the voltage level on the element varies after the undercharge voltage level and before reaching a steady-state voltage level suitable for achieving the aim point voltage level.

12. The method of claim 9 and wherein the voltage level on the element varies after the undercharge voltage level and before reaching a steady-state voltage level suitable for achieving the aim point voltage level.

13. The method of claim 9 and wherein the element is a grid.

14. A method for corona-charging a charge-receiving member, said method comprising the steps of:

synchronizing movement of the charge-receiving member with the application of voltage to a corona-charging apparatus so that, during a transition period, an element of the charging apparatus is provided with an overcharge voltage level substantially higher than a voltage level suitable for achieving an aim point voltage level to which an image frame on the charge-receiving member is to be charged to provide a relatively rapid rate of charge deposition on the charge-receiving member and the voltage on the element is thereafter adjusted to a lower voltage level suitable for achieving the aim point voltage level on the image frame.

15. The method of claim 14 and wherein the element is a grid.

16. The method of claim 15 including the steps of electrostatographically recording an image on said image frame, developing the image and transferring the image to a receiver sheet.

* * * * *